United States Patent [19]

Wu

[11] Patent Number: 4,491,380

[45] Date of Patent: Jan. 1, 1985

[54] RECEIVING MEANS ADAPTED FOR A PUSH-IN TYPE LAMP SOCKET

[76] Inventor: Jeng-Shyong Wu, 133 Tungshing Rd., Toufun, Maulii, Taiwan

[21] Appl. No.: 240,009

[22] Filed: Mar. 3, 1981

[51] Int. Cl.[3] ..... H01R 13/58

[52] U.S. Cl. ..... 339/105; 339/210 T

[58] Field of Search ..... 339/176 L, 206 L, 210 T, 339/105

[56] References Cited

U.S. PATENT DOCUMENTS

| | | | |
|---|---|---|---|
| 2,984,813 | 5/1961 | Bossi | 339/176 L X |
| 3,522,579 | 8/1970 | Matsuya | 339/176 L X |
| 3,936,131 | 2/1976 | Durand | 339/176 L X |
| 4,298,923 | 11/1981 | Lin | 339/176 L X |

FOREIGN PATENT DOCUMENTS

| | | | |
|---|---|---|---|
| 639028 | 5/1962 | Italy | 339/176 L |

*Primary Examiner*—Eugene F. Desmond

*Attorney, Agent, or Firm*—Kalish & Gilster

[57] ABSTRACT

A lamp socket for receiving a push-in type lamp is provided with receiving structure for being contained within the socket housing. Such structure includes a receptacle element having joined halves defining between them a central slot for receiving the push-in lamp base, from which emerge two wire leads for the lamp, such leads being bent back on opposite sides of the base tip. The joined halves of the receptacle elements define recesses at opposite ends of the slot for holding contacts at the ends of insulated leads. The halves are joined by an intermediary bar having a tab-like portion protruding downwardly with the leads on opposite faces. This portion is received by a ring-like clamp element. Outer surfaces of the downwardly-protruding portion are uneven and shaped complementarily to uneven inner surfaces of the clamp element for clamping the leads when joined.

7 Claims, 10 Drawing Figures

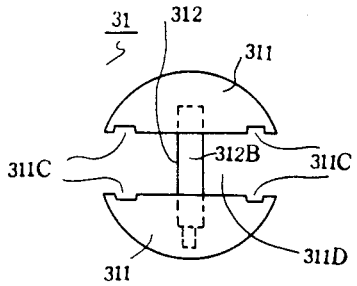
FIG. 3C
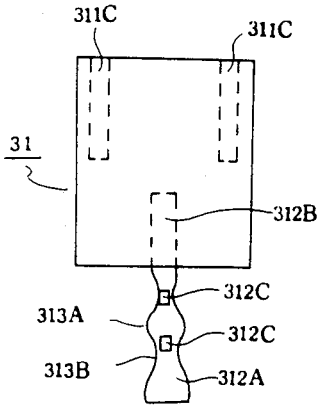
FIG. 3A
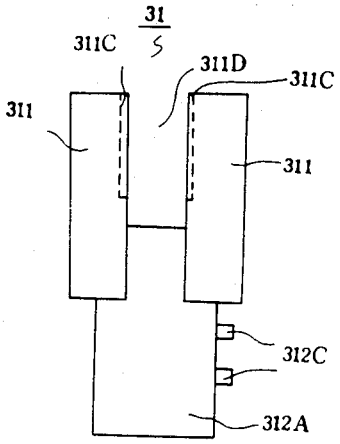
FIG. 3B
FIG. 4B
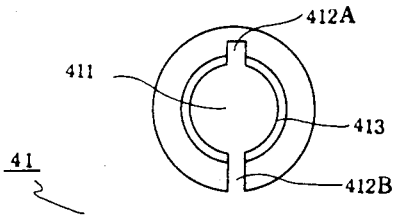
FIG. 4A
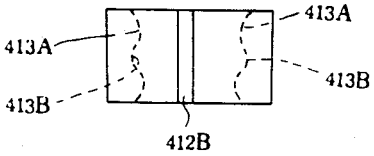
FIG. 5
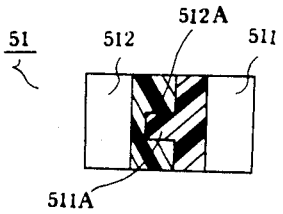
FIG. 6
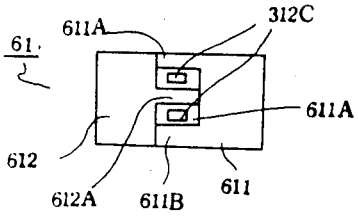

RECEIVING MEANS ADAPTED FOR A PUSH-IN TYPE LAMP SOCKET

FIELD AND BACKGROUND OF THE INVENTION

The present invention generally relates to a lamp receiving device and more particularly to an improvement in a lamp socket for receiving a push-in type lamp.

As is known in the art, there are a plurality of defects, caused by its inadequate constitution, presented in a traditional lamp socket adapted for a receiving of a push-in type lamp, such as:

A. A contact or conductive wire housed in the socket is usually exposed out of the socket to cause a short circuit or electrical strike or arc since the said contact or conductive wire can not be contained tightly within the socket.

B. The contact or conductive wire is always displaced improperly since it can not be clamped firmly within the socket. Therefore, an electrical malformation or occurence, such as short circuit and strike, frequently occurs.

C. In case of an improper clamping of the two constituent conductive wires which are presented for two contacts, then these two conductive wires either are cut or the PVC insulation of the wire is broken, an electrical short circuit will be caused.

D. The two electrical poles in the lamp socket can not be maintained adequately separated.

SUMMARY OF THE INVENTION

It is an object of the present invention to provide a novel lamp socket in which an insulative clamp element and an unique receptacle means are joined together and housed in the lower end of the lamp socket to enable a firmly combination a constituent components.

A further object of the present invention is to provide a lamp socket for receiving a push-in type lamp which is inherently reliable yet inexpensive to assemble and manufacture.

A still further object of the present invention is to provide a lamp socket for receiving a push-in type lamp in which all constituent components of the lamp socket can be fixed firmly in the socket so that any possible electrical dangers can be eliminated.

The foregoing and many other objects of the present invention will become apparent in the following description and drawings:

DESCRIPTION OF THE DRAWINGS

FIG. 3A is a front elevation view of a receptacle means which is to be received in the lamp socket according to this invention.

FIG. 3B is a side elevation view of the socket of FIG. 3A.

FIG. 3C is a top plan view of the socket of FIG. 3A.

FIG. 4A is a side elevation view of an embodiment of a lamp element which is to be fitted within the bottom end of the lamp socket according to this invention.

FIG. 4B is a top view of FIG. 4A.

FIG. 5 is a cross-sectional view of a second embodiment of a clamp element of the invention.

FIG. 6 is a cross-sectional view of a third embodiment of a clamp element of the invention.

DETAILED DESCRIPTION OF THE INVENTION

Figure 1:
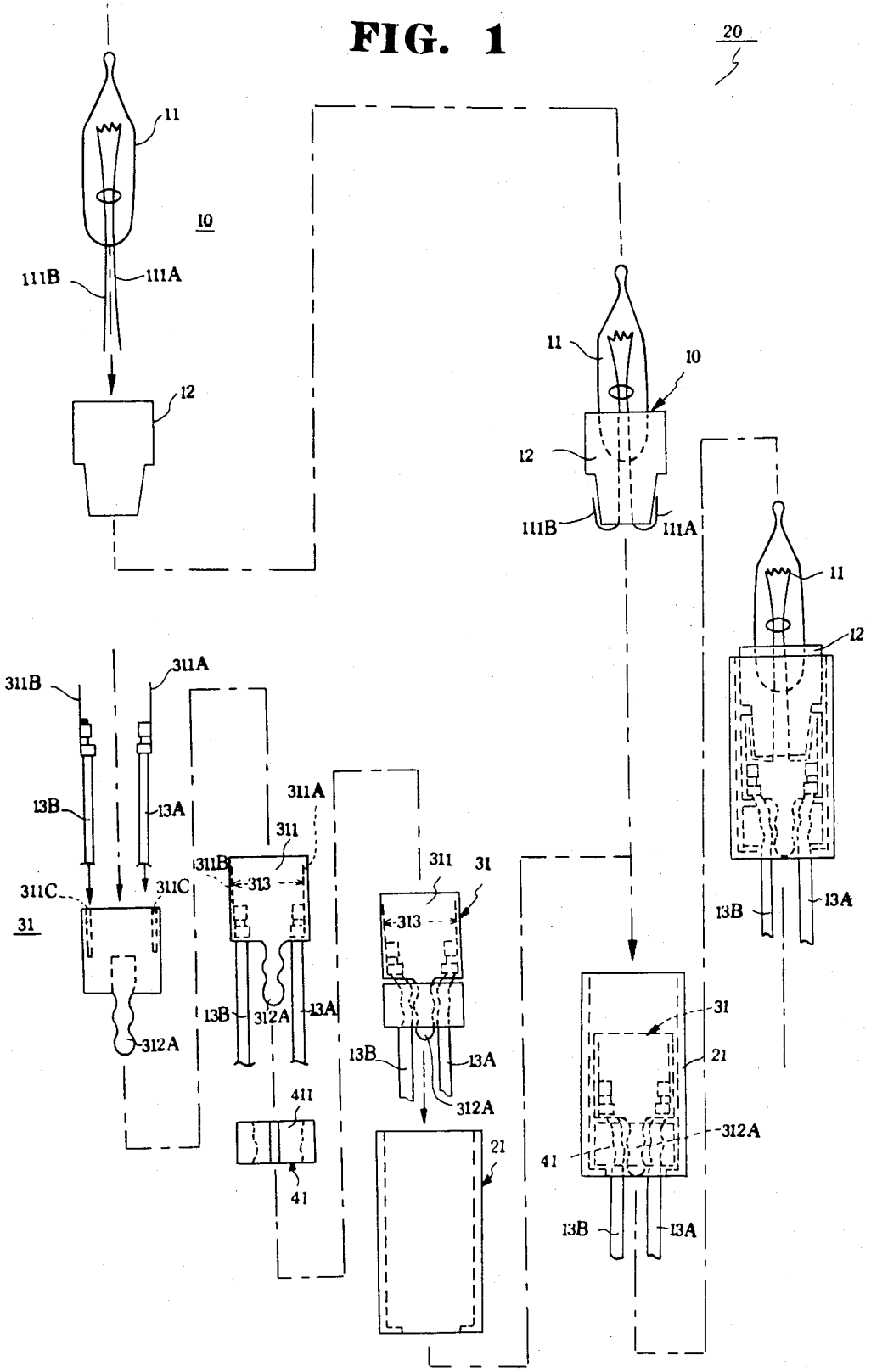
FIG. 1 is an exploded elevation view of the lamp socket as configured for receiving a push-in type lamp in accordance with this invention.
Figure 2A:
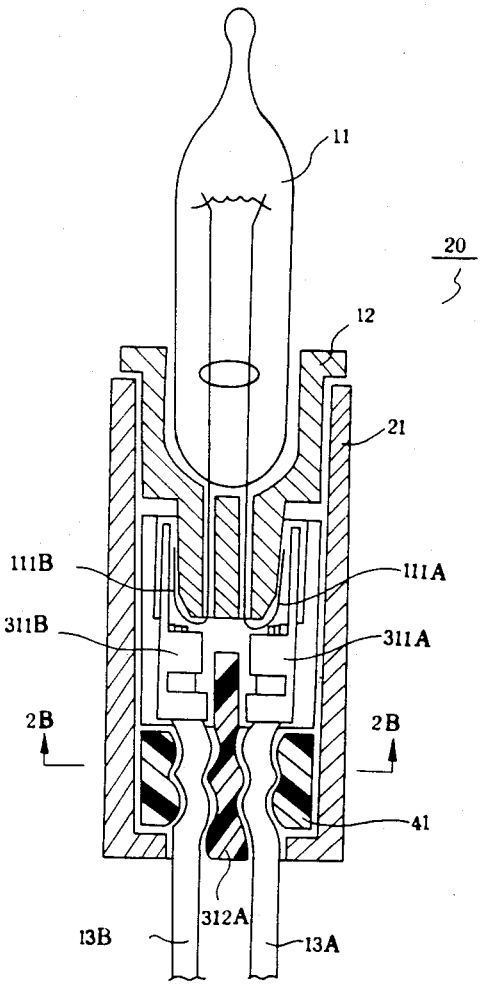
FIG. 2A is a vertical, longitudinal sectional view of the new lamp socket.
Figure 2B:
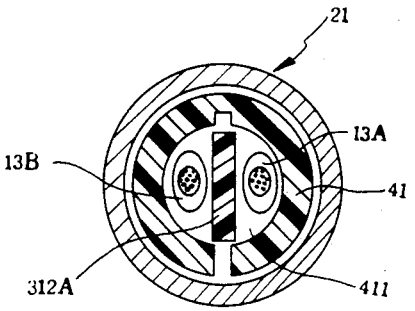
FIG. 2B is a horizontal cross-sectional view taken on line 2B—2B of FIG. 2A.

As shown in the drawings, referring first to FIGS. 1 and 2, the lamp socket 20 according to the invention comprises a hollow, tubular housing 21, a receptacle means 31 and a clamp element 41; a lamp set 10 having a lamp bulb 11 and an insulative lamp base 12 is to be received into the said receptacle means 31.

The receptacle means 31 is constituted by an insulative body 311 having a downwardly protruding portion 312A; two contacts 311A, 311B connected with corresponding insulated conductive wires or leads 13A, 13B are oppositely mounted in the body 311 to form a central slot or recess 313 between each other for receiving the insulative lamp base 12 of the lamp set 10 from which extend two wire leads 111A, 111B of the lamp bulb 11 said leads being folded back on opposite sides of the tip of base 12 for corresponding contact with contacts 311A, 311B.

An insulative clamp element 41 having a central hollow portion 411 is provided for receivingly clamping the downwardly protruding portion 312A and wires 13A, 13B.

The detailed structures of the receptacle means 31 and the clamp element 41 will be described below.

Referring now to FIGS. 3A, 3B and 3C of the detailed structure of receptacle means 31, the latter is formed by two insulative halves 311—311 with a longitudinal intermediary bar 312, each half 311 having two recesses 311C—311C for the purpose of fitting the said two contacts 311A, 311B. Opposite ends of an upper portion of the intermediary bar 312 are respectively connected to said two halves 311 to form a slot-like space between said two halves 311 for receiving the lamp base 12. The lower portion 312A of the bar 312 protrudes or extends downward to serve as a separator, being tab-like and formed into a fluted configuration or wave form to provide uneven opposite faces, specifically a plurality of convex and concave regions or portions 313A and 313B. Two projections 312C are provided at one edge the extrusive portion 312A. The function of said convex and concave portions 313A and 313B as well as the projections 312C is to provide joining to the clamp element 41 as described below.

A detailed structure of the clamp element 41 is shown in FIGS. 4A and 4B. The clamp element 41 is made of insulative material, and a section of which is formed in horse hoof-like or annular configuration. The clamp element 41 has a longitudinal hollow portion 411 and two opposite slots 412A, 412B, one slot 412A being formed in an inner wall 413 of the clamp element 41, the other slot 412B being formed between the proximate free ends of the clamp 41. The diameter of the clamp element 41 can be ajusted easily via these slots 412A, 412B. The inner wall 413 is formed into a wave form, having a plurality of convex and concave portions 413A and 413B. Therefore, the downwardly protruding portion 312A of the receptacle means 31 can be joined firmly to the inner surface 413 of the clamp element 41 since the convex and concave portions 313A and 313B of portion 312A complement the concave and convex portions 413B and 413A of the clamp element 41 when they are fitted together, the wave forms matching and being symmetrically with respect to bar 312B.

FIG. 5 shows a second embodiment of the clamp element, the clamp element 51 being formed by two pieces 511, 512. An extended portion 511A of one piece 511 is inserted into a recess 512A of another piece 512 to attain a tight relation.

FIG. 6 shows a third embodiment of the clamp element in which the clamp element 61 is also constituted by two pieces 611 and 612, one piece 611 having at least one recess 611A and fixed flanges 611B. Meanwhile, the other piece 612 of the clamp element 61 has at least one extended portion 612A, which provides recesses 611A for receiving extensions 312C on the protruding portion 312A to prevent the constituent components, such as the contacts 311A, 311B and the conductive wires 13A, 13B, housed within the socket from looseness and displacement.

It is appreciated, from the foregoing description, that at least the following advantages are presented in the present invention:

A. The conductive wires 13A, 13B are separated exactly via the protruding portion 312A; thus, short circuit caused by mutual contact of conductive wires 13A, 13B is prevented surely.

B. All conductive portions such as the two contacts and bare portions of the conductive wires are built in to the receptacle means; that is, no conductive portions are exposed out of the lamp socket. Therefore, a possible short circuit, etc, is prevented.

C. The conductive wires are difficult to move or displace caused by the fit between the protruding portion 312A and the inner wall 413 of the clamp element 41.

In the foregoing, the present invention has been described solely in connection with a preferred embodiment thereof. Since may variations and modifications of the present invention will now be obvious to those who are skilled in this art, it is preferred that the scope of this invention is determined not by the specific disclosure herein contained but only by the appended claims.

I claim:

1. A lamp socket for receiving a push-in type lamp, said lamp being carried by a tipped base having wire leads on opposite sides of the base tip, said socket comprising a housing of hollow, tubular character including openings at top and bottom for respectively receiving the lamp and base from the top and a pair of insulated conductive wires from the bottom, receptacle means of insulative material for being received by and contained within the housing, the receptacle means having two joined symmetrical halves defining a central slot between them for receiving the base tip and recesses at opposite ends of the slot for fitting therein of contacts at the ends of said wires for contacting the lamp leads, said halves being joined by an intermediary bar having a tab-like lower portion protruding downwardly from said joined halves with said wires on opposite faces thereof, said faces providing uneven outer surfaces, and a clamp element of insulative material and ring-like configuration, the clamp element being receivable by and contained within the housing below said receptacle means for receiving the downwardly protruding portion thereof and said wires, said clamp element having an uneven inner surface shaped complementarily to said uneven faces for clamping said wires in precisely separated relationship on opposite sides of said protruding portion when said downwardly protruding portion is received by said clamp means.

2. A lamp socket as set forth in claim 1 wherein both the outer surfaces of the downwardly protruding portion and the inner surface of the clamp elements are defined by a plurality of convex and concave regions to provide a wave form.

3. A lamp socket as set forth in claim 2 wherein the convex and concave regions of said downwardly protruding portion are symmetrical with respect to said intermediary bar, the wave form of the downwardly-protruding portion matching the wave form of the clamp element.

4. A lamp socket as set forth in claim 1 wherein the clamp element is of horse hoof-like configuration, being split longitudinally along one side for providing proximate free ends defining a slot between them, there being a further longitudinal slot along the inner wall opposite from the first-said slot, said downwardly-protruding portion having an edge provided with at least one projection for being received by said further slot.

5. A lamp socket as set forth in claim 4 wherein there are two such projections spaced apart along one edge of said downwardly-protruding portion for being received by said further slot.

6. A lamp socket as set forth in claim 1 wherein said clamp element is constituted by two pieces, one of which has at least one projection and the other having at least one corresponding recess for receiving said projection.

7. A lamp socket as set forth in claim 6 wherein, when joined together, said two pieces define at least one opening into the side wall of said clamp element, the downwardly-protruding portion having at least one radial projection for being received by the defined opening.

* * * * *